United States Patent [19]

Stengel

[11] 4,133,751

[45] Jan. 9, 1979

[54] WIRE SCREEN WITH TENSIONING ASSEMBLY

[76] Inventor: Joseph E. Stengel, R.R. #2, Walnut, Ill. 61376

[21] Appl. No.: 782,921

[22] Filed: Mar. 30, 1977

[51] Int. Cl.[2] ..... B07B 1/49

[52] U.S. Cl. ..... 209/404; 209/274; 209/400

[58] Field of Search ..... 209/319, 395, 400, 408, 209/404–405, 403, 274, 275, 281; 210/DIG. 3, 499; 245/10; 140/107, 109; 52/222, 273; 254/67, 83; 256/42, 44, 37; 81/52.4 R

[56] References Cited

U.S. PATENT DOCUMENTS

| | | | |
|---|---|---|---|
| 810,682 | 1/1906 | Shafer et al. | 209/400 |
| 878,728 | 2/1908 | Harrop | 209/400 |
| 1,032,566 | 7/1912 | Rogers | 254/67 |
| 1,138,127 | 5/1915 | Loftus | 256/37 |
| 1,175,727 | 3/1916 | Edwards | 254/67 |
| 2,010,256 | 8/1935 | Cole | 209/403 |
| 2,019,253 | 10/1935 | Cramp | 209/400 |
| 2,983,381 | 5/1961 | Ball | 209/400 |
| 3,221,852 | 12/1965 | Thomas | 81/52.4 R |

*Primary Examiner*—Robert Halper

*Assistant Examiner*—Jon E. Hokanson

*Attorney, Agent, or Firm*—Lionel L. Lucchesi

[57] ABSTRACT

A sizing screen for sizing particulate materials, for example, is provided which uses a plurality of wire loops arranged to define a plurality of parallel wire strands extending between a first end and a second end of a screen frame. The frame has anchor means mounted at its first end and tension means at its second end. In the simplest form of the invention, pairs of wire strands are adjusted simultaneously by the tension means. In more advanced forms of the invention, means are provided for adjusting pluralities of the wire loops, each wire loop adjustment corresponding to two wire strand adjustments. The frame is constructed so that the wire strands have a double crown. One crown extends along the width dimension of the frame, and a second crown extends along the length dimension of the frame. The double crown arrangement promotes more even spreading of material as that material travels along the wire screen and is important in maintaining wire strand position. Various other features include a unique method of wire loop attachment to the frame, and means for setting the tension of each wire loop automatically.

13 Claims, 17 Drawing Figures

WIRE SCREEN WITH TENSIONING ASSEMBLY

BACKGROUND OF THE INVENTION

This invention relates to sizing screens for use in vibrating screen devices for sizing particulate materials. While the invention is described with particular reference to its preferred application in aggregate production, those skilled in the art will recognize the wider applicability of the inventive concepts disclosed hereinafter.

Aggregate production generally is conducted through the use of units known in the art as screen plants, which may be mobile or stationary. The screen plant is positioned in a first suitable location and may be repositioned, if desired, as conditions demand. The screen plant generally includes a suitable conveyor system which carries the material to a vibrating deck assembly, normally including at least a first sizing deck and a second sizing deck. The material is deposited on the first sizing deck by the conveyor and particular sized aggregate is dropped through the first deck to the second deck. The second deck also is a vibrating screen deck intended to size the material a second time, passing desired small size material through the deck, and depositing more coarse material on the output side of the vibrating screen assembly. The small material is the desired product and is collected by suitable means for later use.

Screen decks of various constructions for use in vibrating deck assemblies are well known in the art. However, various conditions inherent in aggregate operations, for example, moisture, fineness, clay content and size irregularity, have hampered production. In some cases, these problems or conditions cause production to be seasonal in nature. Clay content and moisture in particular can cause vibrating screen deck assembly malfunction, resulting in increased maintenance cost and decreases in product output.

One solution to these problems has been the design of a vibrating screen deck which uses a plurality of parallel wire strands extending along a frame structure to delimit the bed of the screen. The wire strand form of screen bed has improved production of vibrating screen plants. However, wire screen devices, while generally showing promise in various aggregate installations, have been plagued with operational problems in the field. For example, one commercially available wire screen design employs a plurality of individual lengths of wire or wire strands, each of which is fed through relatively complicated mechanisms. Since applicational use of the screen bed often results in wear on the wire strands, wire strand breakage or wire strand wear commonly requires field replacement of the wire strand. With devices known prior to my invention, wire strand replacement is a formidable task when conducted in the field. Proper wire strand tension after replacement also is difficult to achieve, unless relatively expensive devices in the form of torque wrenches are available.

Use of a "crown" for a screen deck to distribute the material over the entire area of the deck, thereby increasing the efficiency of the screen, is an old expedient. That is to say, screen beds often have a curved cross section along their width dimensions. In wire screen designs, this is accomplished by bending the frame members used to support the wire strands. It has been conventional in wire screen designs to notch or groove the frame members so that each wire strand has a predetermined individual location on each frame member, those locations being aligned longitudinally along the screen deck. In prior art devices, operation of the apparatus often results in the displacement of one or more of the wire strands from its predetermined groove position so that the wire strand moves towards or away from adjacent wire strands along the bed. When a sufficient number of wire strands are so mispositioned, the screens can become blocked, or the sizing variation present in the output of the screen becomes unsatisfactory.

My invention overcomes these prior art deficiencies by utilizing a screen bed employing close ended wire loops positioned from end to end along the screen bed frame. Because of wire loop use, at least two strands of wire can be tensioned simultaneously, and means for tensioning the wire loops are provided on a first end of the frame. When breakage of a particular wire loop occurs, replacement is accomplished easily with the screen of this invention because of the simplified method and structure for inserting the wire loop in the wire screen. The wire screen also is provided with a second crown along the longitudinal length of the bed. The second crown helps to maintain tension on the wire strands during operational use, so that the wire strands maintain proper spacing along the bed. Consequently, screen maintenance is reduced, the desired output of the screen deck is predictable within a predetermined size tolerance, and overall plant production is increased.

One of the objects of this invention is to provide an improved wire screen having a plurality of wire strands arranged in double crown configuration.

Another object of this invention is to provide a wire screen employing continuous wire loops, extended over the axial length of the screen deck, sides of the wire loops defining wire strands of the deck.

Another object of this invention is to provide means for tensioning the wire strands of a screen deck more simply, efficiently, and economically than heretofore available.

Another object of this invention is to provide means for simultaneously tensioning a plurality of wire strands of a screen deck.

Another object of this invention is to provide simplified means for attaching the wire strands of a screen deck to the screen deck frame.

Other objects of this invention will be apparent to those skilled in the art in light of the following description and accompanying drawings.

SUMMARY OF THE INVENTION

In accordance with this invention, generally stated, a screen deck for a vibrating screen plant is provided which includes a frame having first and second ends. A plurality of wire strands extend between the first and second ends. Parts of the wire strands are defined by predetermined side lengths of individual closed loops of wire. Simplified means for attaching the wire loops to the first end of the deck and simplified means for tensioning the wire loops along the second end of the screen deck are provided and employ a novel shaped bolt having a "J" shape in plan. Means for tightening the bolts includes a socket member having a breakaway torque set to give proper tensioning of the wire strands. Because wire loops are employed, tension adjustment may be accomplished simultaneously for at least two wire strands.

DESCRIPTION OF THE PREFERRED EMBODIMENT

Figure 1:
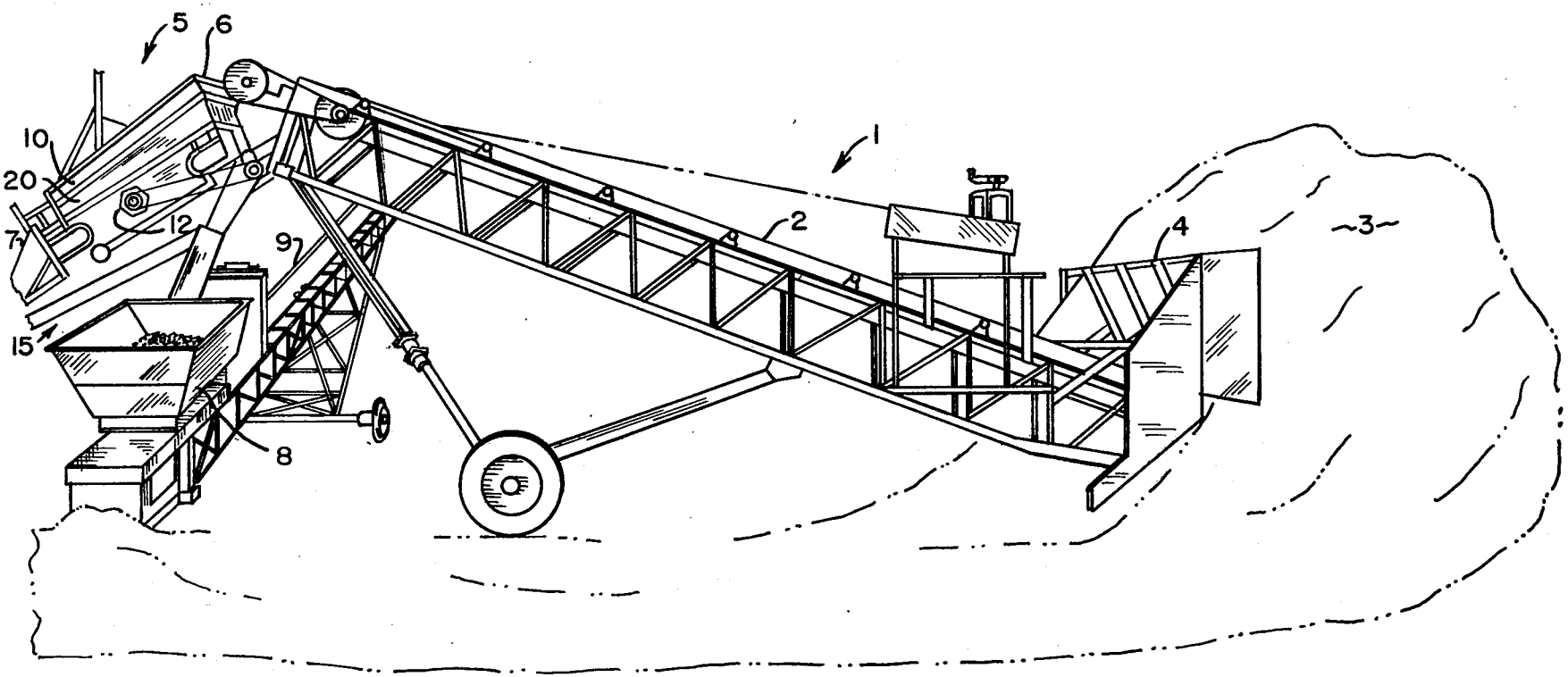
FIG. 1 is a view in perspective of a screen plant utilizing one illustrative embodiment of screen deck of this invention.

Referring now to FIG. 1, reference numeral 1 indicates a screen plant in which the screen deck of this invention finds application. The screen plant 1 includes a conveyor 2 which is used to move aggregate 3 from a source point 4 to a vibrating screen assembly 5. Vibrating screen assembly 5 has an input side 6 and a waste output side 7. Properly sized material from the plant 1 is an output along a bottom 15 of the assembly 5. The properly sized material commonly is collected in a suitable collecting hopper 8. Material in the hopper 8 may be transferred to a second location for storage by means of a suitable conveyor 9.

Vibrating screen assemblies similar to the assembly 5 are well known in the art. In general, the assembly 5 includes a first upper screen deck 10, and a second lower screen deck 20 which are used to size the aggregate material 3 to a predetermined size. The screen decks 10 and 20 of the assembly 5 are moved by conventionally operated cam or excentric devices indicated generally by the numeral 12 in FIG. 1.

Figure 2:
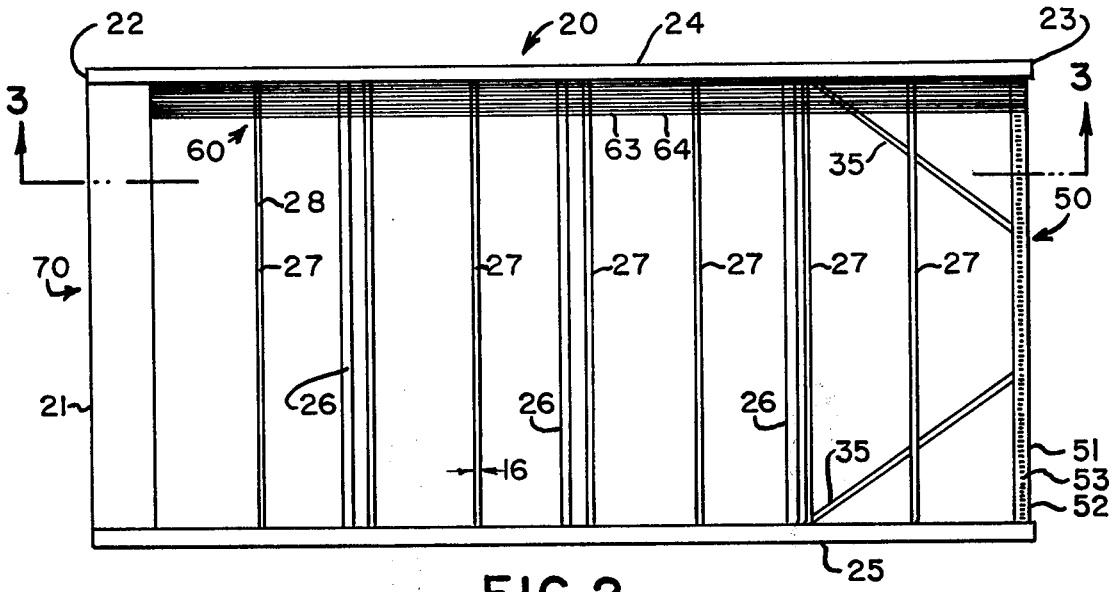
FIG. 2 is a top plan view of a screen deck compatible with the screen plant of FIG. 1.

As indicated above, high moisture or high clay content in the aggregate 3 causes a considerable problem in screen plant 1 operation, in that high moisture or clay content can cause misoperation of the vibrating screen assembly 5. Screen decks constructed in accordance with the principals of my invention, however, are easily maintained in production, and are not subject to the more common problems associated with vibrating screen assembly 5 operation. An illustrative embodiment of the screen deck 20 constructed in accordance with the principals of my invention and compatible with the vibrating screen assembly 5 is shown in FIG. 2. In general, I have found that only one of the screen decks need be constructed as described below to provide improved screen plant 1 operation. Both of the upper and lower decks may be so constructed, however, if desired.

The screen deck 20 includes a frame assembly 21 having a first end 22 and a second end 23. The frame assembly 21 is skeleton in nature and includes a first side rail 24 and a second side rail 25 spaced from and parallel to one another. The side rails 24 and 25 may assume a variety of configurations. The embodiment illustrated utilizes conventional girders having a C-shape in cross section for the side rails. Structural rigidity between the side rails 24 and 25 is maintained through a plurality of cross members 26 predeterminedly spaced along the longitudinal axis of the frame assembly 21. Cross members 26 likewise may comprise C-shaped channel members which are attached to the side rails 24 and 25 by any convenient method. Welding works well, for example. A pair of stabilizer struts 35 extend between the respective ones of the rails 24 and 25 and an anchor end support 50.

Figure 3:
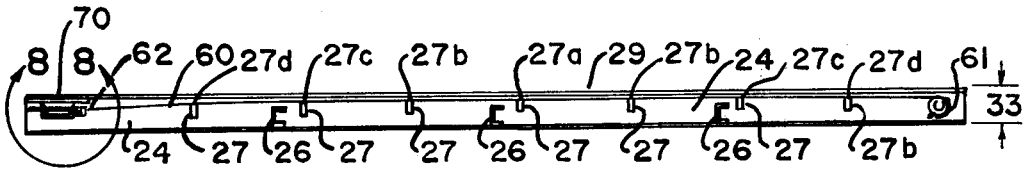
FIG. 3 is a sectional view taken along the line 3—3 of FIG. 2.

A plurality of ribs 27 also are attached between the side rails 24 and 25. The ribs 27 preferably are rectangular in cross section, or at least have a flat upper surface 28. The ribs 27 are positioned between the side rails 24 and 25 at varying heights along a depth dimension 33 of the side rails 24 and 25, as is best observable in FIG. 3. That is to say, the ribs 27 are positioned so that a line drawn generally tangent to the surface 28 of the ribs 27 will have a predeterminedly shaped curve imparted to it, so that a rib 27*a* is nearer a top side 29 of the side rails 24 and 25 than a pair of ribs 27*b* which in turn are nearer the top side 29 than a pair of ribs 27*c* which in turn are nearer the top side 29 of the rails 24 and 25 than a pair of ribs 27*d,* the rib 27*a* defining the dividing line between succeeding rib pairs. Consequently, a wire strand extending between the ends 22 and 23 of the frame assembly 21 will have a crown imparted to it along the longitudinal length of the frame assembly. The crown provided along the longitudinal length of the frame assembly 21 is important for reasons later explained in greater detail. It is here sufficient only to note the existence and importance of that crown.

Figure 4:
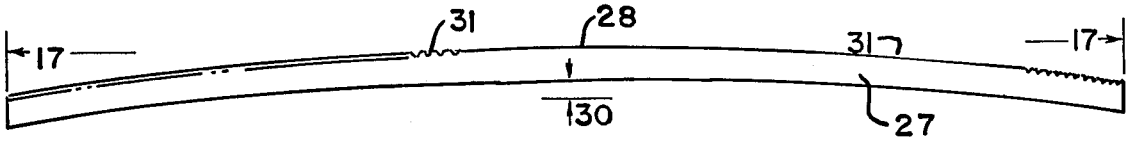
FIG. 4 is a view in side elevation of a rib member utilized in conjunction with the screen deck of FIG. 2.
Figure 5:
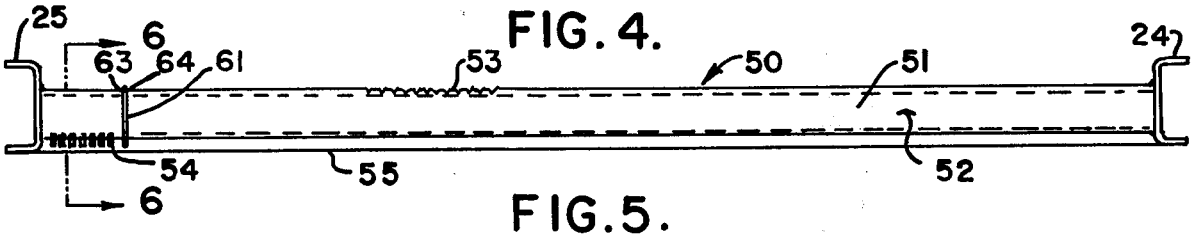
FIG. 5 is a view in side elevation of an anchor end support means utilized in conjunction with the screen deck of FIG. 2.

The ribs 27 are similar to one another, and are attached to the rails 24 and 25 by any convenient method. Again, welding works well. As shown in FIG. 4, the ribs 27 also have a second crown 30 imparted to them. The use of the crown 30 in screen bed design is a known expedient provided so that material, which normally falls upon the frame assembly 21 from the end 22 side thereof, will be spread toward the side rails 24 and 25, thereby utilizing a larger area of the screen bed for sizing and increasing the efficiency of the vibrating screen assembly 5. The upper surface 28 of the ribs has a plurality of notches 31 formed in it. The notches 31 are identical and extend along a width dimension 16 of each rib 27. The notches 31 are placed at specific distances from one another along a length dimension 17 of the ribs, for purposes later described.

Figure 6:
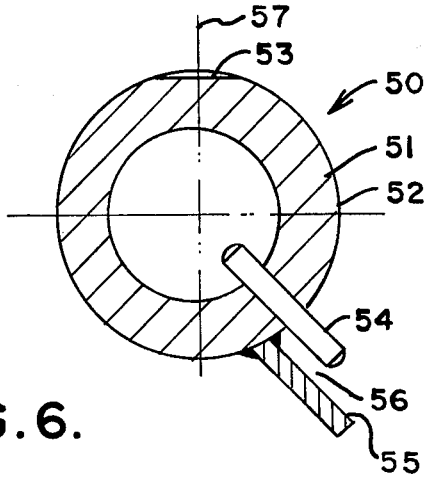
FIG. 6 is a sectional view, taken along the line 6—6 of FIG. 5.

The anchor end support 50 is mounted along the end 23 of the frame assembly 21, between the side rails 24 and 25. Anchor end support 50 includes a tubular member 51 having a side wall 52. The member 51 has a plurality of grooves 53 formed in it. Each of the grooves 53 are aligned with respective ones of the notches 31 in the ribs 27, so that a plurality of discrete channels extend along the longitudinal length of the frame assembly 21. A multiplicity of pins 54 are mounted to the member 51 and extends radially outwardly therefrom. Each of the pins 54 preferably is a tapered drive pin inserted in a suitable opening, formed in the member 51. A bar 55 is attached to the member 51 near the pins 54 and is spaced from the pins so that respective ones of the pins 54 and bar define a plurality of receptacles 56. The bar 55 forms a protective lip about each of the receptacles 56 for purposes later described. The diameter of the pin 54 is important. The diameter of pin 54 is chosen so that placement of an end of a wire loop 60, the wire used to form the loop 60 having a predetermined diameter, will enable two longitudinal lengths of the loop 60 to be aligned with two adjacent ones of the grooves 53 in the member 51. Actual pin 54 angular location relative to the grooves 53 may vary. Preferably, it is rotated at least 90° in a clockwise direction from an axis 57, shown in FIG. 6, clockwise being referenced to FIG. 6.

Figure 14:
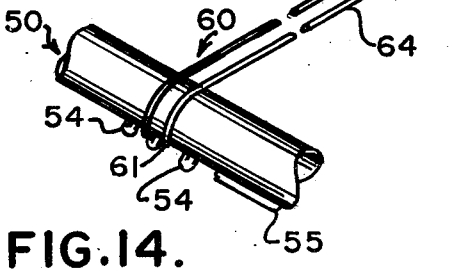
FIG. 14 is a view in perspective, partly broken away, of one illustrative embodiment of wire strand compatible with the screen deck of FIG. 2.

The wire loop 60, best seen in FIG. 14, preferably is oil tempered spring steel or stainless steel wire formed in a continuous loop and having a first end 61 and a second end 62. The end 61 is formed in a predetermined radius to correspond with desired wire spacing and to assist both in placement of the end 61 in the receptacle 56 and to conform the end 61 to the side wall 52 of the member 51. The gauge of wire used in the loop 60 varies with the desired opened area of the screen. I have found that between seventy and eighty percent open area works well. In any event, the loop 60 is constructed by butt welding the ends of a predetermined length of wire to form a first wire strand 63 and a second wire strand 64.

Figure 7:
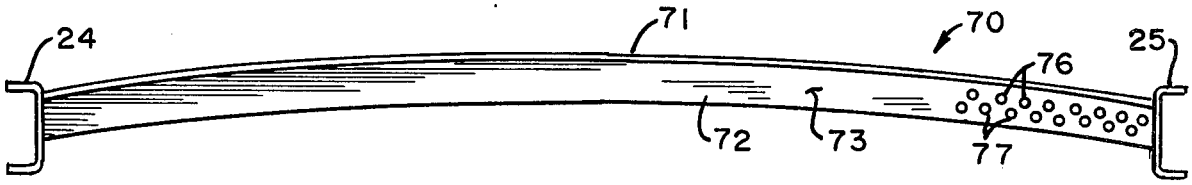
FIG. 7 is a view in side elevation of a tension head utilized in conjunction with the screen deck of FIG. 2.
Figure 8:
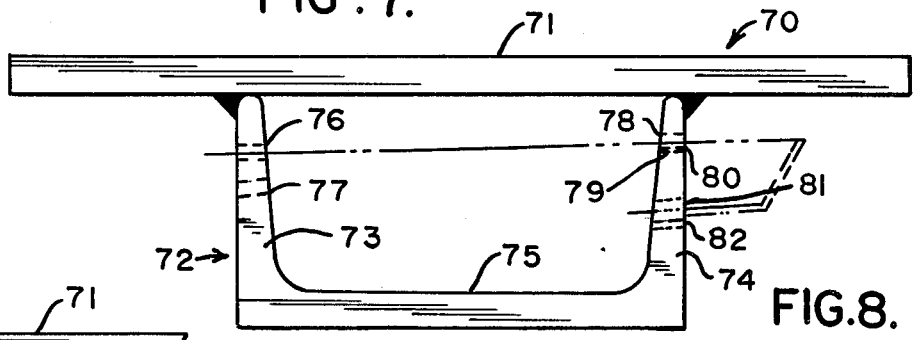
FIG. 8 is an enlarged view taken about the area 8—8 of FIG. 3, illustrating operation of the tension head.

A tensioning assembly 70 is attached to the frame assembly 21 along the end 22 of the frame. Tensioning assembly 70, best described in conjunction with FIGS. 7 and 8, includes a top plate 71 having a U-channel support member 72 attached to it. The support 72 includes a first wall 73 and a second wall 74 interconnected by a web 75.

The wall 73 has a plurality of openings 76 arranged in a first upper horizontal row, and a second plurality of openings 77 arranged in a second lower horizontal row, the openings 76 and 77 being offset with respect to one another in their vertical relationship. The wall 74 has a corresponding plurality of openings 78 and 79 arranged so that a point 80 of respective pairs of the openings 78 and 79 lie in the same plane. That is to say, the points "80" of each of the openings 78 and 79 are aligned linearly in a plane perpendicular to the plane of FIG. 8, that plane passing through the point 80 there shown. The wall 74 has a second plurality of openings 81 and 82 aligned with respective ones of the respective openings 78 and 79, for purposes later described in detail.

Figure 8A:
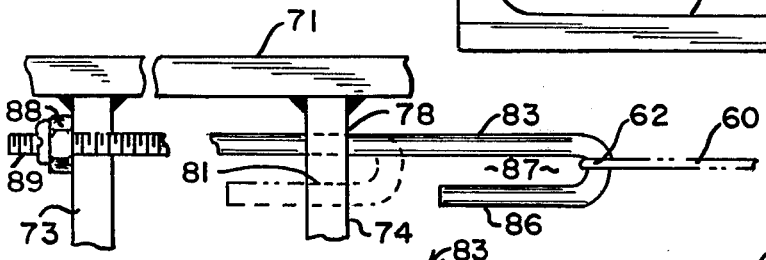
FIG. 8*a* is a view, partly broken away, generally corresponding to FIG. 8, illustrating first and second positions for a J-bolt used in conjunction with the tension head of FIGS. 7 and 8.
Figure 9:
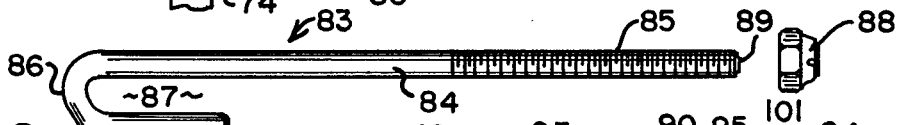
FIG. 9 is a view in side elevation of the J-bolt shown in FIG. 8*a;*

A tensioning bolt 83, best observed in FIG. 9, is inserted in each of the openings 78 and 79 and their respective counterpart openings 76 and 77. The bolt 83 includes a body 84 having a threaded first end 85 and a predeterminedly formed second end 86 shaped to give the bolt 83 a "J" shape in plan. In particular, the end 86 defines a receiver 87 along the internal curved portion of the end 86. The body 84 has a diameter chosen to correspond to the spacing or open area desired between the wire strands 63 and 64. The body 84 has a sufficient length to permit the bolt to extend through the walls 73 and 74, along respective ones of the opening pairs 78-76 and 79-77. It should be noted that although the openings 76 and 77 are offset with respect to one another, because the point 80 of the openings 78 and 79 are aligned with one another, the point 80 also ensures that the ends 86 of the bolts are aligned with one another along the wall 74 side of the tensioning assembly 70. A nut 88 is intermounted to the end 85 of the body 84 and is used to move the bolt 83 between at least a first position, shown in full lines of that Figure. In the first position shown, the end 86 is spaced from the wall 74 so that the receiver 87 is open and may receive the end 62 of the wire loop 60. In the second position, the end 86 is drawn leftwardly, referenced to FIG. 8*a*, thereby locking the end 62 of the wire strand 60 within the receiver 87. Bolts inserted through the openings 76 and 78, have their ends 86 positioned in the openings 81 while bolts inserted through the openings 77 and 79 have their ends 86 positioned in the openings 82 of the tensioning assembly 70.

It is apparent that the wire loops 60 may be placed along the frame assembly 21 so that the end 61 of the wire loops are positioned in the receptacles 56, while the ends 62 are placed in the receivers 87 of the bolts 83. Thereafter, the bolts may be drawn to the second phantom line position shown in FIG. 8*a* by tightening the nut 88. Various degrees of tension may be held or placed on the wire loops 60 by the application of various torque conditions at the bolts 88. The longitudinal length of the loop 60 defines the first and second wire strands 63 and 64, respectively. Individual ones of the wire strands 63 and 64 are carried along respective ones of the notches 31 in the ribs 27 and the grooves 53 in the anchor end support 50. The crown along the longitudinal length of the frame assembly 21 determined by the placement of the respective ribs 27*a*–27*d* is important in that rib location is instrumental in maintaining the position of the wire strands 63 and 64 in the notches or grooves. That is to say, after tensioning of the wire loop 60, the curvature provided by rib location tends to lock individual ones of the wire strands 63 and 64 in their proper position, that position being delimited by the notch 31-groove 53 relationship described above. Consequently, problems associated with mispositioned wires common in prior art screen deck designs are largely eliminated.

The screen deck 20 of this invention is intended to be compatible with prior art screen plant 1 designs. The deck 20, in particular, can be made compatible because the tensioning assembly 70 and end anchor support 50 need not protrude beyond the longitudinal length of prior vibrating screen assemblies. Likewise, the depth 33 of the screen 20 can be made compatible with those same designs. As indicated, the crown 30 of the double crown arrangement of the wire strands provided by the rib 27 arch construction spreads the material over the total screen area, while the second crown tends to maintain the position of the wire strands 63 and 64. Because of screen 20 construction, required maintenance and down-time are reduced. The breakage of one of the wire strands 63 and 64 requires the replacement of a single wire loop 60. This may be accomplished easily by moving the bolt 83 to its first, wire loop receiving position, inserting the new wire loop 60, and retightening of the bolt. If desired, an end 89 of the bolt 83 may be deformed after initial nut 88 placement to prevent nut 88 removal and subsequent loss when inserting replacements of the wire loops 60.

Figure 10:
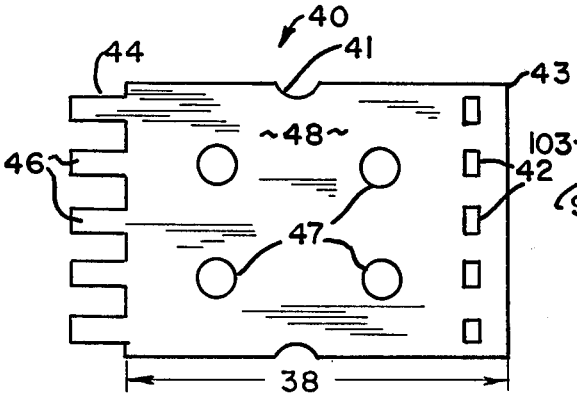
FIG. 10 is a top plan view of a header means compatible with the screen deck of FIG. 2.
Figure 10A:
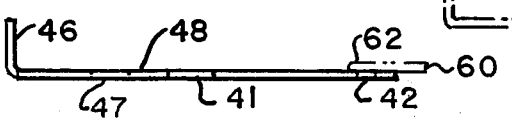
FIG. 10*a* is a view in side elevation of the header means of FIG. 10, showing a succeeding constructional step in header means construction.
Figure 10B:
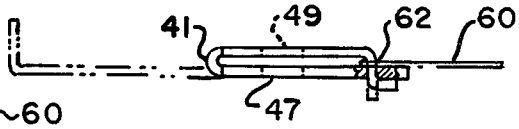
FIG. 10*b* is a view in side elevation of the header means of FIG. 10, showing a final constructional step in header means construction.

A second method for attaching the wire loops 60 to the frame assembly 21 is shown in FIGS. 10, 10*a* and 10*b*. As there shown, a header 40 includes a body portion 48 having a generally rectangular shape in plan. The body portion 48 has a first end 43, a second end 44, and a longitudinal length 38 between these ends. A pair of opposed notches 41 are formed approximately midway of longitudinal length 38. The body portion 48 has a plurality of openings 42 formed in it near the end 43 and a plurality of tabs 46 formed along the end 44, the tabs 46 being aligned with the openings 42 and sized for reception therein as later discribed. The header preferably is constructed from sheet metal, for example, of a predetermined thickness. The thickness is chosen so that header 40 provides sufficient structural rigidity in use but is easy to manufacture in a conventional punch press operation. After formation, the tabs 46 are folded perpendicularly to the body portion 48, as shown in FIG. 10*a*. The wire loops 60 then are positioned so that individual ones of the wire loops encircle respective ones of the openings 42. Thereafter, the body portion 48 is folded upon itself along the notches 41 so that the tabs 46 enter the openings 42 and pass through the ends of the wire loops 60. The resulting structure is shown in FIG. 10*b*. When so formed, the wire loops 60 are clamped between the folded halves of the body portion 48. The ends of the tabs 46 preferably are again folded, as shown in FIG. 10*b*, to obtain and maintain the final form of the body portion 48.

Body portion 48 also has a plurality of aligned openings 47 formed in it. When the body portion 48 is in its folded condition, the openings 47 define a pair of channels 49 through the body portion 48. The channels 49 are sized to receive the ends 86 of the bolts 83, permitting attachment of the header 40 to the tensioning assembly 70.

Use of the header 40 is desirable in that each of the headers 40 shown holds five of the wire loops 60. Consequently, 10 wire strands may be position along the frame 21 and tensioned simultaneously. The number of wire loops held by a particular header 40 design may vary in other embodiments of this invention. Use of the header 40 simplifies the attachment and tensioning of multiple ones of the wire loops 60, thereby generally simplifying construction of the frame assembly 21.

Figure 11:
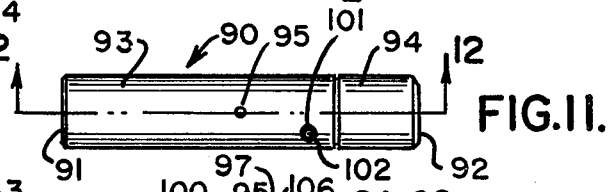
FIG. 11 is a top plan view of a torque socket unit utilized for tensioning the wire strands of the screen deck shown in FIG. 2.
Figure 12:
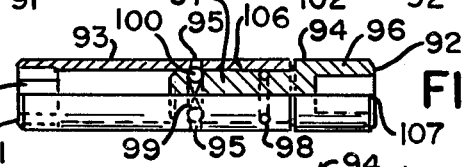
FIG. 12 is a sectional view, taken along the line 12—12 of FIG. 11.
Figure 13:
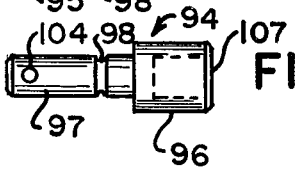
FIG. 13 is a view in side elevation of a drive end means used in torque socket unit shown in FIG. 11.

Tensioning the wire loops 60 may be achieved in a number of ways. Conventional torque wrenches may be employed, if desired. However, FIGS. 11–13 illustrate a torque means 90 having a nut 88 receiving or socket end 91 and a drive or ratchet end 92. The torque means 90 includes a first part 93 having the socket end 91 formed therein, and a second part 94 having the drive end 92 formed therein. The part 93 generally is a tubular structure having an axial opening 106 extending at least partially through it. End 91 of part 93 also has a presized nut 88 receiving socket 103 formed in it. A pair of oppositely directed radial openings 95 extend through the part 93 and communicate with the axial opening 106. The part 93 also has an opening 101 passing through it.

The part 94 includes a head portion 96 having a drive means channel 107 formed along the end 92, and a shank 97 extending axially outwardly from the end 92. Shank 97 has a groove 98 formed about its perimeter, and a diametric passage 104 extending through it. The groove 98 and passage 104 are spaced axially from one another along the shank 97. The shank 97 of the part 94 is sized for insertion in the axial opening 106 of the part 93. When so inserted, groove 98 aligns with opening 101 while the passage 104 aligns with the openings 95. The passage 104 is sized to receive a spring 99 and a pair of steel ball bearings 100. The spring 99 biases the ball bearings 100 outwardly and into interlocking relationship with the radial openings 95 in the intermounted position of the parts 93 and 94. After intermounting of the parts 93 and 94, a roll pin 102 is inserted through the opening 101 and a portion of the annular groove 98 so that the shank 97 of the part 94 is tangent to the roll pin at the groove 98.

In operation, the spring 99 and the diameter of the openings 95 are chosen so that upon the application of a torque greater than a predetermined torque along the drive end 92 of the part 94, the ball bearings 100 will compress against the spring 99, permitting rotation of the part 94 within the part 93. That is to say, the spring 99 and diameter of the openings 95 are designed so that the force required to permit spring compression by the ball bearings 100 will also torque the nut 88 properly with respect to the bolt 83, bring the bolt to the second, phantom line position shown in FIG. 8*a*, thereby automatically setting the correct tension for the wire loop 60. The roll pin 102 merely maintains the part 94 in its intermounted position with respect to the part 93 and permits relative rotation of those parts upon compression of the spring 99.

Numerous variations, within the scope of the appended claims, will be apparent to those skilled in the art in light of the foregoing description and accompanying drawings. Thus, the size and dimensions of the various components may be varied in other embodiments of this invention. Likewise, the number of openings in the walls 73 and 74, of the tensioning assembly 70, the number of pins 54 used in conjunction with the anchor end support 50, and the related notches and grooves in the ribs and tubular support member 51 all may vary in other embodiments of this invention. While particular structural shapes were described as preferred, other shapes are compatible with the broader aspects of this invention. For example, the ribs 27 have been found to function more effectively with a flat upper surface 28. However, tubular members, while less desirable, may be used. The design silhouette, shape or placement of various structural components and method of supporting the various structural components all may vary. The design of header means 40 also may be changed. For example, a more formalized hinge arrangement may be employed. In like manner, the number of wire loops held by the header means 40 may be altered. Other constructions for the torque means 90 are compatible with the broader aspects of my invention. These variations are merely illustrative.

Having thus described the invention, what is claimed and desired to be secured by Letters Patent is:

1. A screen deck for use in a vibrating bed apparatus for grading various size materials, comprising:

a pair of spaced side rails;

a plurality of cross members mounted between said side rails, said cross members being attached to said rails at predetermined distances from one another, said cross members and said rails together defining a frame structure having a first end, a second end, a length dimension and a width dimension;

a tensioning assembly mounted along the first end of said frame structure, said tensioning assembly including first and second walls spaced from one another, said first wall having a first plurality of openings in it, said second wall having a corresponding second plurality of openings in it, individual ones of said first and second opening pluralities being aligned to define a passage through said first and second walls, said second wall further having a third plurality of openings in it, and a plurality of bolts, individual ones of said bolts being mounted in the passage defined by said first and said second opening pluralities, each of said bolts having a first end extending outwardly of said first wall and a second end having a predetermined shape arranged so that movement of the first end of said first bolt in a direction away from said first wall draws the second end of said bolt toward and into individual ones of said third plurality of openings in said second wall;

an anchor end support means mounted along the second end of said frame; and a plurality of ribs mounted between said side rails, each of said ribs having a predetermined curvature imparted to it along its longitudinal axis, the curvature of said ribs delimiting a first crown for said screen deck, said ribs being mounted between said side rails at various heights with respect to one another to give said screen deck a second crown along the length dimension of said frame structure, said ribs and said anchor end support having a plurality of notches and grooves respectively, formed in them, and a plurality of closed wire loops, said wire loops being constructed from a predetermined length of wire, the ends of which are joined to each other to form a loop, each of said wire loops being arranged into an elongated shape having a first end and a second end, said wire loop delimiting a first wire strand and a second wire strand extending between the first and second ends of said wire loops, said wire loops being positioned so as to extend between the bolts of said tensioning assembly and said anchor end support means, respective ones of the first and second wire strands of said wire loops being carried in the notches and grooves of said ribs and said anchor end support means.

2. The device of claim 1 further characterized by header means for attaching a plurality of said wire loops simultaneously to said frame, said header means including clamp means for holding a plurality of the first ends of said wire loops and means for attaching said headers to said tensioning assembly.

3. The device of claim 2 wherein said header means has at least one passage formed in it , said passageway permitting the interconnection of said header means with said tensioning assembly, the bolts of said tensioning assembly having a J-shape, said header means being attached to at least one of said bolts along a receiver defined by the curved part of said J-shape, the end of said J-shape being insertable in said third plurality of openings to lock said header and wire loops within said frame structure.

4. The device of claim 1 wherein the bolts of said tensioning assembly have a J-shape, the first end of said wire loop being carried along a hook defined by the J-shape, the hook being inserted in said third plurality of openings to lock the wire loop in place along said frame structure.

5. The device of claim 4 wherein said anchor end support means comprises a tubular member extending along the width dimension of said frame structure, said tubular member having a plurality of pins extending outwardly from it along the length dimension of said frame structure, said pins being sized to receive the second end of said wire loop.

6. The device of claim 5 further including means for setting the tension of said wire loops at said tensioning assembly, said tension setting means including torque means having a drive part and a socket part intermounted with one another, and means for permitting the rotation of said drive part with respect to said socket part upon the application of a predetermined amount of force on said torque means.

7. A screen deck, comprising:

a frame including a pair of spaced side rails, said frame having a first end and a second end, a width dimension and a length dimension;

a tension assembly mounted along the first end of said frame, said tension assembly including a first wall, said first wall having a first plurality of openings formed in it, a second wall, said second wall having a second plurality of openings formed in and aligned with said first plurality of openings, said second wall further having a third plurality of openings disaligned with an axis defined by said first and said second plurality of aligned openings, and a plurality of bolts, individual ones of said bolts extending between ones of said first and second plurality of openings along the axis defined thereby and extending outwardly of said first and said second walls, said bolts having a shape arranged so that continuous movement of said first end in a direction outwardly from said first wall causes the second end of said bolt to move toward engagement with said third plurality of openings;

an anchor end support mounted along the second end of said frame;

a plurality of ribs extending widthwise of said frame, said ribs having a plurality of notches formed in them, said ribs being formed with a predetermined radius of curvature, the curvature of said ribs defining a first crown for said screen bed, said ribs being positioned at varying heights along said frame, said varying height position defining a second crown for said screen bed; and a plurality of closed wire loops formed to extend longitudinally between said anchor end support and said tension assembly, said wire loops including a first wire strand, a second wire strand and first and second end portions integrally connecting said first and said second wire strands, the first end portion of said loop being attached to an individual one of said bolt plurality, the second end portion of said wire loop being attached to said anchor end support, individual ones of said wire strands being received in the notches of said ribs.

8. The screen deck of claim 7 wherein said anchor end support comprises a tubular member extending along the width dimension of said frame, said tubular member having a plurality of pins extending outwardly from it along the length dimension of said frame, said pins being sized to receive an end portion of said wire loop.

9. The screen deck of claim 8 wherein said bolts have a J-shape, the curve of said J being insertable in said third plurality of openings to lock said wire loops within said frame structure.

10. The screen deck of claim 9 including means for setting the tension of said wire strands at said tension assembly, said tension setting means including torque means having a drive part and a socket part, and means for permitting selective rotation of said drive part between said socket part upon the application of a predetermined amount of force on said torque means.

11. In a wire screen for sizing material, including a frame having a first end and a second end, the improvement which comprises a plurality of closed wire loops extending between the first and second ends of said frame, the longitudinal length of each of said wire loops delimiting a first wire strand and a second wire strand, means for anchoring said wire loops on the second end of said frame, means for tensioning said wire loops on a first end of said frame, said tensioning means including a plurality of bolts each of said bolts having a curved end, and at least one wall, said wall permitting a reciprocal passage of said bolts, said wall having a first plurality of openings in it arranged so that the reciprocal movement of said bolts through said wall permits the engagement and disengagement of respective ones of said bolts in respective ones of said first opening plurality, header means interconnected between said wire loop and at least one of said said bolts, said header means coacting with said bolt so that at least four strands of wire are tensioned simultaneously, said header means including means for selectively engaging loops of wire, and means for connecting said header means to said bolt to interlock said wire loops in said frame structure, and a predetermined number of rib members extending across a width dimension of said frame, said rib members engaging said wire strands in supportive relationship thereto, said rib members being curved to give the wire strands of said wire loops a first crown along said frame, said rib members being attached to said frame at varying heights to give said wire strands a second crown along said frame.

12. The improvement of claim 11 wherein said tensioning means is further characterized by a second wall spaced from said first wall, said first wall having said first plurality of openings in it, said first wall having a second plurality of openings in it permitting passage of said bolts, said second wall having a third plurality of openings in it aligned with said second plurality of openings along centerline axes of respective pairs of said second and said third opening plurality, said bolts being mounted through said second and said third plurality of said openings in said respective first and second walls along the centerline axis defined by the opening pairs, said bolts having a J-shape, the curve of said J-shape being sized for and receivable in the first plurality of openings during tensioning of said wire strands.

13. The improvement of claim 12 wherein said anchoring means comprises a tubular member extending across said frame, said tubular member having a plurality of pins extending outwardly from it along a length dimension of said frame, said pins being sized to receive an end of said wire loops.

* * * * *